US007530543B1

(12) United States Patent
Kremzar

(10) Patent No.: US 7,530,543 B1
(45) Date of Patent: May 12, 2009

(54) SUPPORT STAND FOR WINDOW BLINDS AND SCREENS

(76) Inventor: Carl M. Kremzar, 16 Bristol St., Wallingford, CT (US) 06492

( * ) Notice: Subject to any disclaimer, the term of this patent is extended or adjusted under 35 U.S.C. 154(b) by 230 days.

(21) Appl. No.: 11/127,067

(22) Filed: May 12, 2005

(51) Int. Cl.
*A47B 19/00* (2006.01)

(52) U.S. Cl. ..... 248/441.1; 248/451; 248/122.1; 248/125.1; 248/125.8; 248/188.5; 248/188.7; 248/266; 248/269; 248/452; 248/453; 248/460; 248/463; 248/464; 248/434; 248/435; 248/176.3; 248/188.6; 40/607.04; 40/607.1; 40/610; 160/24; 160/34

(58) Field of Classification Search ..... 248/441.1, 248/451, 122.1, 125.1, 125.8, 188.5, 188.7, 248/266, 269, 452, 453, 460, 463, 464, 434, 248/435, 176.3, 188.6; 40/607.04, 607.1, 40/610; 160/24, 34
See application file for complete search history.

(56) References Cited

U.S. PATENT DOCUMENTS

| | | | | | |
|---|---|---|---|---|---|
| 505,306 | A | | 9/1893 | Bohlinger | |
| 723,114 | A | * | 3/1903 | Witt | 211/205 |
| 983,589 | A | * | 2/1911 | Wendt | 211/196 |
| 987,884 | A | * | 3/1911 | Jellison | 248/461 |
| 1,075,395 | A | * | 10/1913 | Beegle | 211/196 |
| 1,434,511 | A | * | 11/1922 | Swanson | 402/4 |
| 1,450,416 | A | * | 4/1923 | Freshour et al. | 223/120 |
| 4,988,064 | A | * | 1/1991 | Hoshino | 248/170 |
| 5,056,184 | A | | 10/1991 | Pitchford | |
| 5,078,348 | A | | 1/1992 | Babitchenko | |
| D391,706 | S | | 3/1998 | Malcolm | |
| 5,819,961 | A | | 10/1998 | Harris | |
| 6,112,914 | A | * | 9/2000 | Naficy | 211/113 |
| 6,389,721 | B1 | * | 5/2002 | Yang | 40/610 |
| 6,702,130 | B1 | | 3/2004 | Carlilse | |

* cited by examiner

*Primary Examiner*—J. Allen Shriver, II
*Assistant Examiner*—Nkeisha J Dumas

(57) ABSTRACT

An apparatus includes a central support shaft that has an elongated shape provided with axially opposed ends. Rectilinear legs have opposed ends conjoined to the bottom support shaft end and extending outwardly therefrom at an oblique angle. The legs are pivotal between compressed and expanded positions. Auxiliary support shafts have elongated shapes provided with opposed medial and lateral ends. The auxiliary shafts are pivotally conjoined to the brackets and pivotal about the medial ends, such that the auxiliary shafts can be independently biased between vertical and horizontal positions. Brackets are attached to the central support shaft and spaced along a longitudinal length thereof. Clamps are positional along the auxiliary shafts. Each clamp is adaptable between open and closed positions for releasing and gripping the window blind. The window blind is centrally registered between the auxiliary support shafts during cleaning operations.

4 Claims, 10 Drawing Sheets

SUPPORT STAND FOR WINDOW BLINDS AND SCREENS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to support stands and, more particularly, to a support stand for window blinds and screens for holding same at an upright position during cleaning procedures.

2. Prior Art

Venetian blinds and window screens are typically of a cumbersome and awkward construction which discourages frequent cleaning of such blinds and screens. Typically a person is limited to simply removing dust from the blinds or the screen with a conventional duster. This, however, is not sufficient for removing dirt and grime that accumulates on the blinds over extended periods of time.

In order to properly clean such dirt and grime, it is necessary to remove the blind or screen assembly from its mounting bracket and lay it on a support surface. First one side of the blind, or screen, is cleaned. After sufficient time has passed for the first side to dry, the blind or screen is turned over and the other side is cleaned. Procedures such as these are not only energy and time consuming, but also lead to people neglecting their blinds and screens because cleaning them is just too daunting of a task.

Various support structures have been utilized in the prior art to support window blinds and screens to provide a convenient manner of cleaning them, typically in an extended configuration when concerning the blinds. One example of the prior art includes a clothes rack that is provided with a central bar with various support bars fixedly mounted orthogonally relative to the central bar. This design is not sufficient, since the bottom portion of the blind or screen is not fixedly held in place. Thus, during cleaning procedures, the blinds and screens tend to pivot. This makes the cleaning thereof more time consuming and difficult than it needs to be. A further disadvantage of the above mentioned example is the bulky structure thereof. One can not easily store such an assembly, thus it does not hold a great deal of appeal with consumers.

Accordingly, a need remains for a support stand for window blinds and screens in order to overcome the above noted shortcomings. The present invention satisfies such a need by providing a support stand that is easy and convenient to use, light weight, portable and durable in design, and effective. Such a support stand for window blinds and screens provides the user with a quick, simple and effective way to clean and dry their blinds or screens. With the support stand dust, dirt and other debris is easily removed from the blinds and screens in an efficient manner. Such a support stand is easily transported between remote locations, and after use, is conveniently collapsible for easy storage thereof.

BRIEF SUMMARY OF THE INVENTION

In view of the foregoing background, it is therefore an object of the present invention to provide a support stand for window blinds and screens. These and other objects, features, and advantages of the invention are provided by an apparatus for holding window blinds and the like at an upright position during cleaning procedures.

The apparatus includes a central support shaft that has an elongated and rectilinear shape provided with axially opposed end portions disposed along a vertical axis. Such end portions are elevated above a ground surface during operating conditions. The central support shaft preferably includes telescopically engageable female and male members so that a longitudinal length of the apparatus can conveniently be selectively adjusted as desired by the user. A latch is directly fastened to the central support shaft and pivotally adaptable between locked and unlocked positions for effectively prohibiting and allowing the female and male members to slide along the vertical axis respectively.

A plurality of rectilinear and coextensive legs have axially opposed end portions directly conjoined to a bottom one of the central support shaft end portions and extend outwardly therefrom at an oblique angle offset from the vertical axis. Such legs are selectively pivotal between compressed and expanded positions such that the legs become abutted against the central support shaft when articulated to the compressed position. The legs may be provided with a planar platform suitably sized and shaped for resting on the ground surface.

A plurality of coextensive auxiliary support shafts have elongated and rectilinear shapes provided with axially opposed medial and lateral end portions. Such auxiliary support shafts are pivotally conjoined to the brackets and selectively pivotal about the medial end portions respectively such that the auxiliary support shafts can advantageously be independently biased between vertical and horizontal positions respectively.

A plurality of brackets are directly attached to the central support shaft and vertically spaced along a longitudinal length thereof. Such brackets are preferably provided with a planar medial portion and monolithically formed sides extending away therefrom for defining a pathway through which the medial end portions of the auxiliary support shafts are pivotally seated.

A plurality of clamps are slidably positional along associated ones of the auxiliary support shafts wherein each clamp is selectively adaptable between open and closed positions for effectively releasing and gripping the window blind at opposed edges thereof. The window blind is centrally registered between the auxiliary support shafts during cleaning operations. In a preferred embodiment, the clamps may include a plurality of hook and loop fasteners for allowing the user to tightly wrap the clamps about opposite ends of the window blinds respectively.

In an alternate embodiment, the clamps preferably include a plurality of spring-loaded clips sized and shaped to conform with a square cross-section of the auxiliary support shafts. Such spring-loaded clips are readily positional along a longitudinal length of the auxiliary support shafts without becoming detached therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
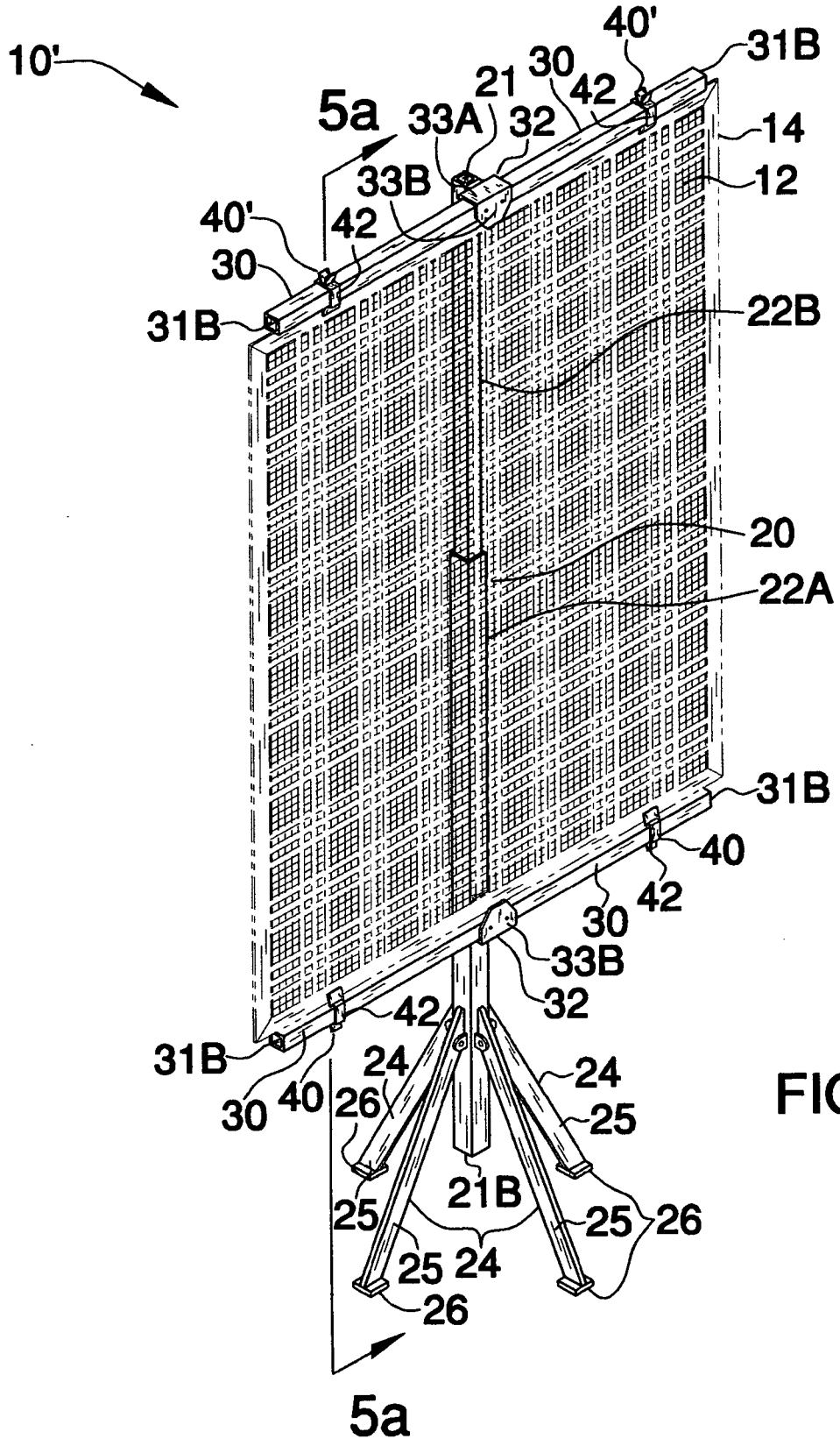
FIG. 1 is a perspective view showing an alternate embodiment of the support stand for window blinds and screens, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to alternate embodiments of such elements.

The apparatus of this invention is referred to generally in FIGS. 1-12 by the reference numeral 10 and is intended to provide a support stand for window blinds and screens. It should be understood that the apparatus 10 may be used to support many different types of objects and should not be limited in use to only supporting window blinds and screens for cleaning purposes.

Figure 2:
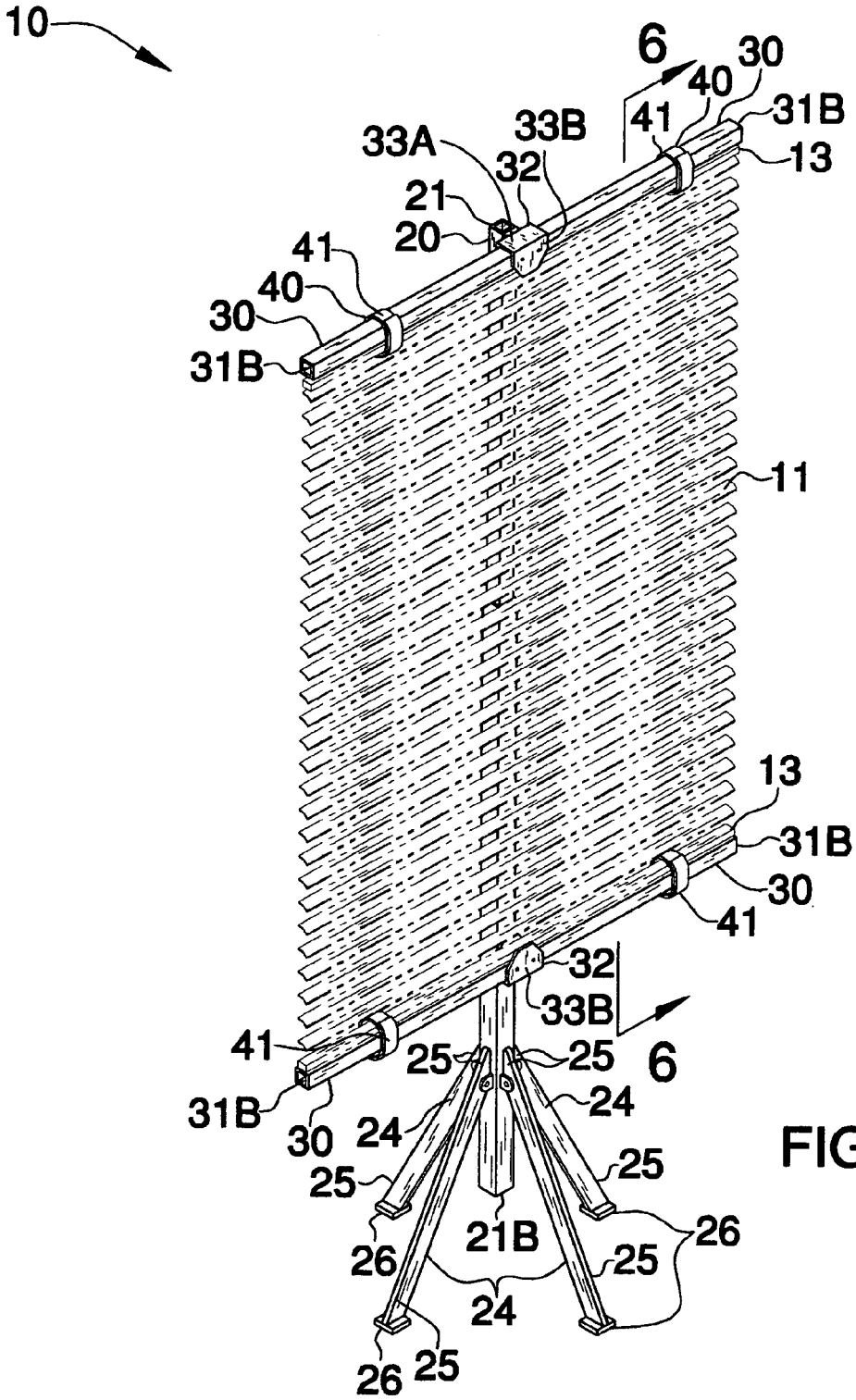
FIG. 2 is a perspective view showing a preferred embodiment of the support stand for window blinds and screens.
Figure 3:
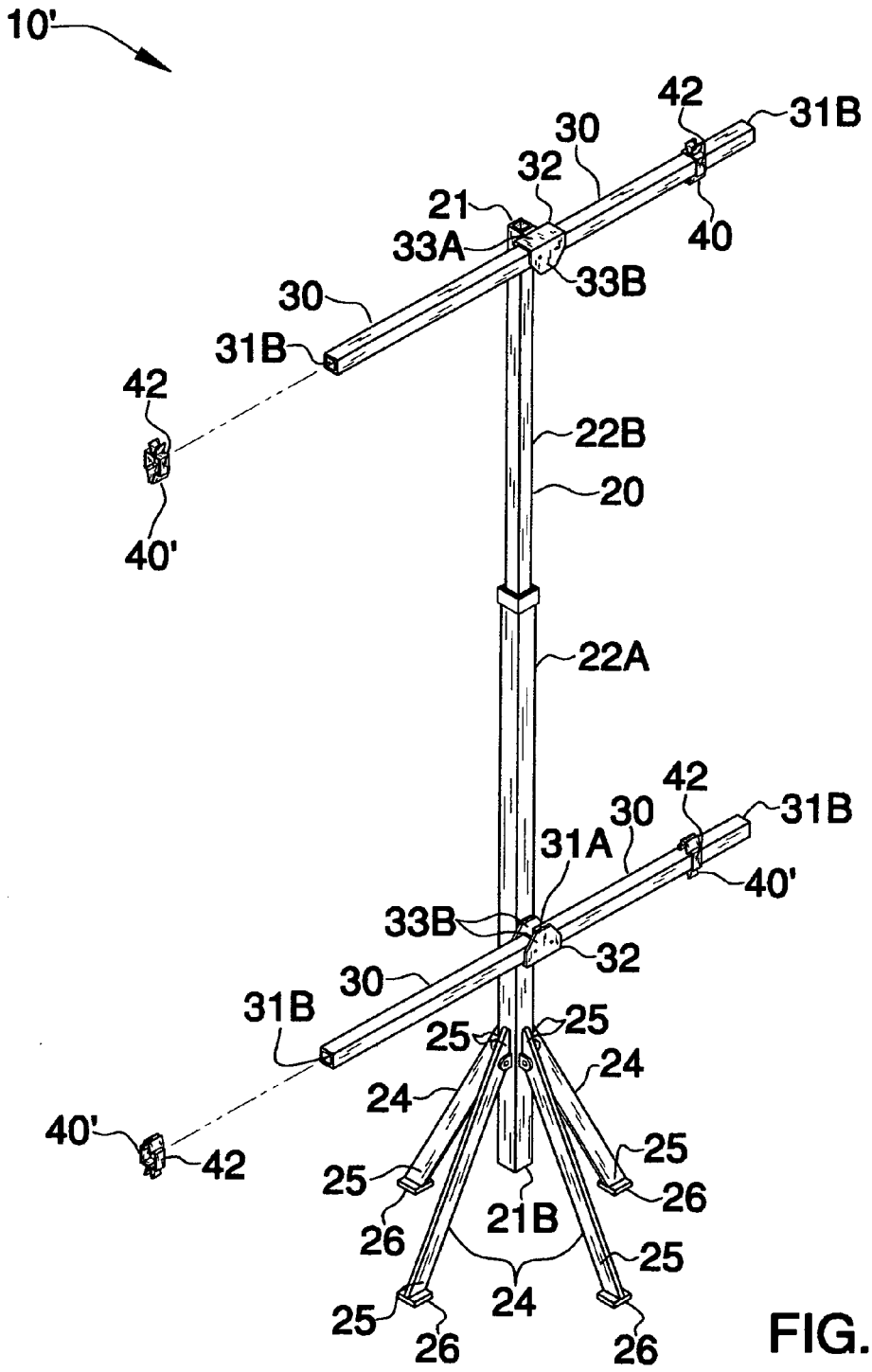
FIG. 3 is perspective view of the apparatus shown in FIG. 1, without the screen attached thereto.
Figure 4:
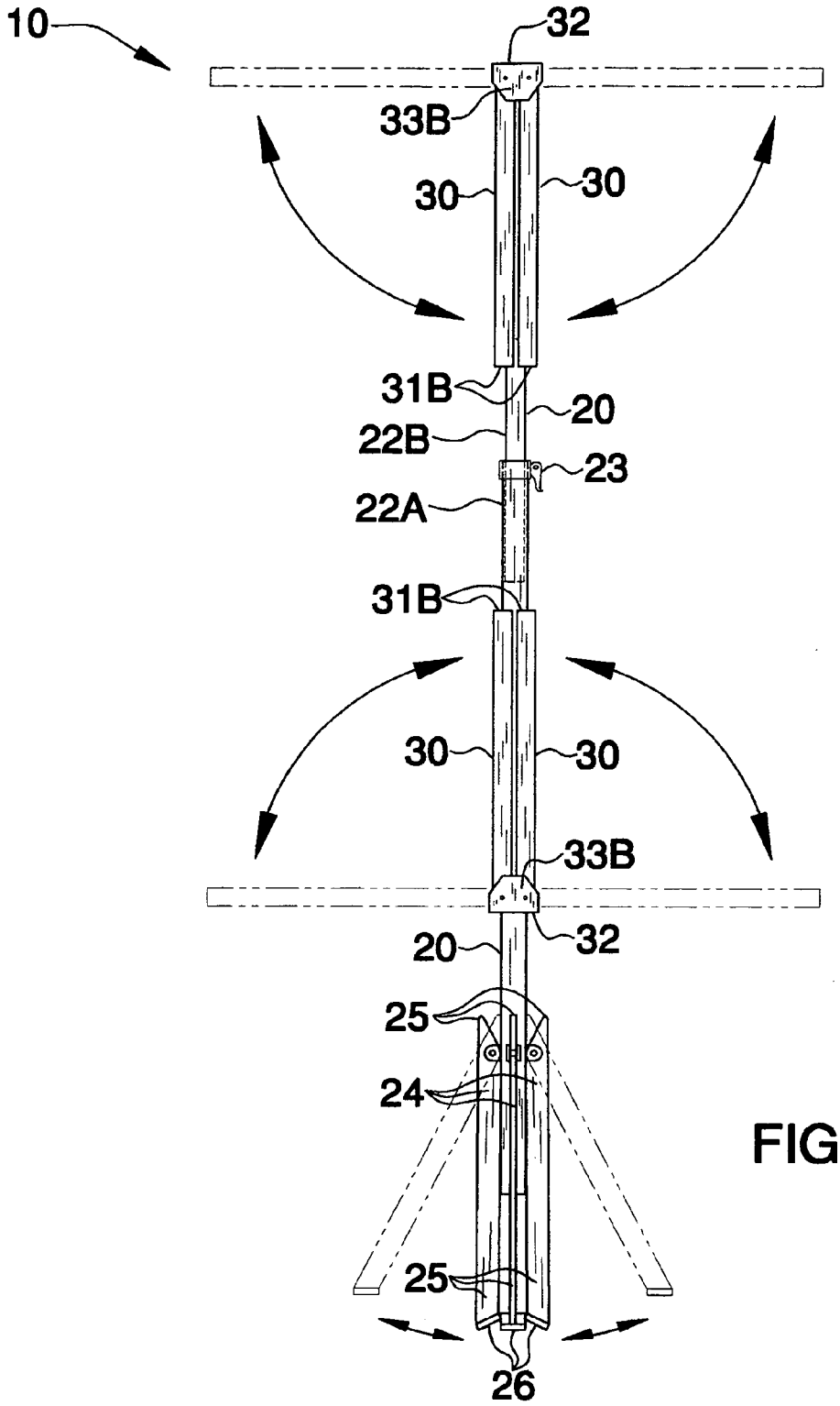
FIG. 4 is a front-elevational view of the apparatus shown in FIG. 2, showing the auxiliary support shafts positioned against the central support shaft.
Figure 5A:
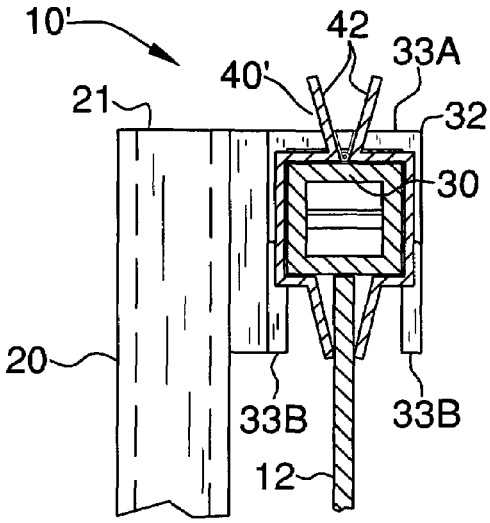
FIG. 5*a* is a cross-sectional view of the apparatus shown in FIG. 1, taken along line 5-5 and showing the spring-loaded clip at a closed position.
Figure 5B:
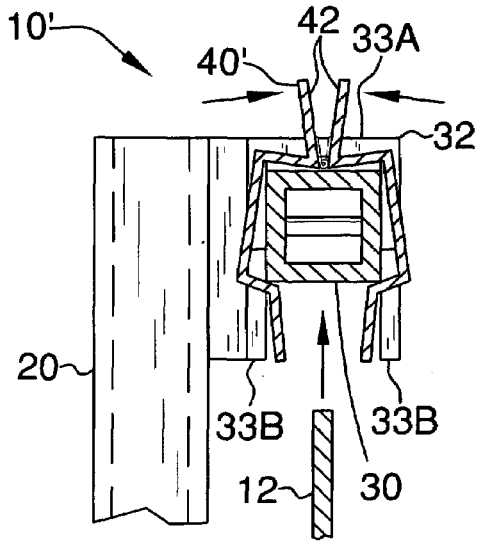
FIG. 5*b* is a cross-sectional view of the apparatus shown in FIG. 1, taken along line 5-5 and showing the spring-loaded clip at an open position.
Figure 6:
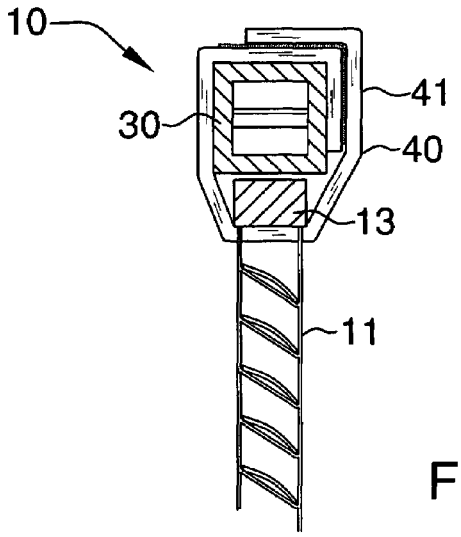
FIG. 6 is a cross-sectional view of the apparatus shown in FIG. 2.
Figure 9:
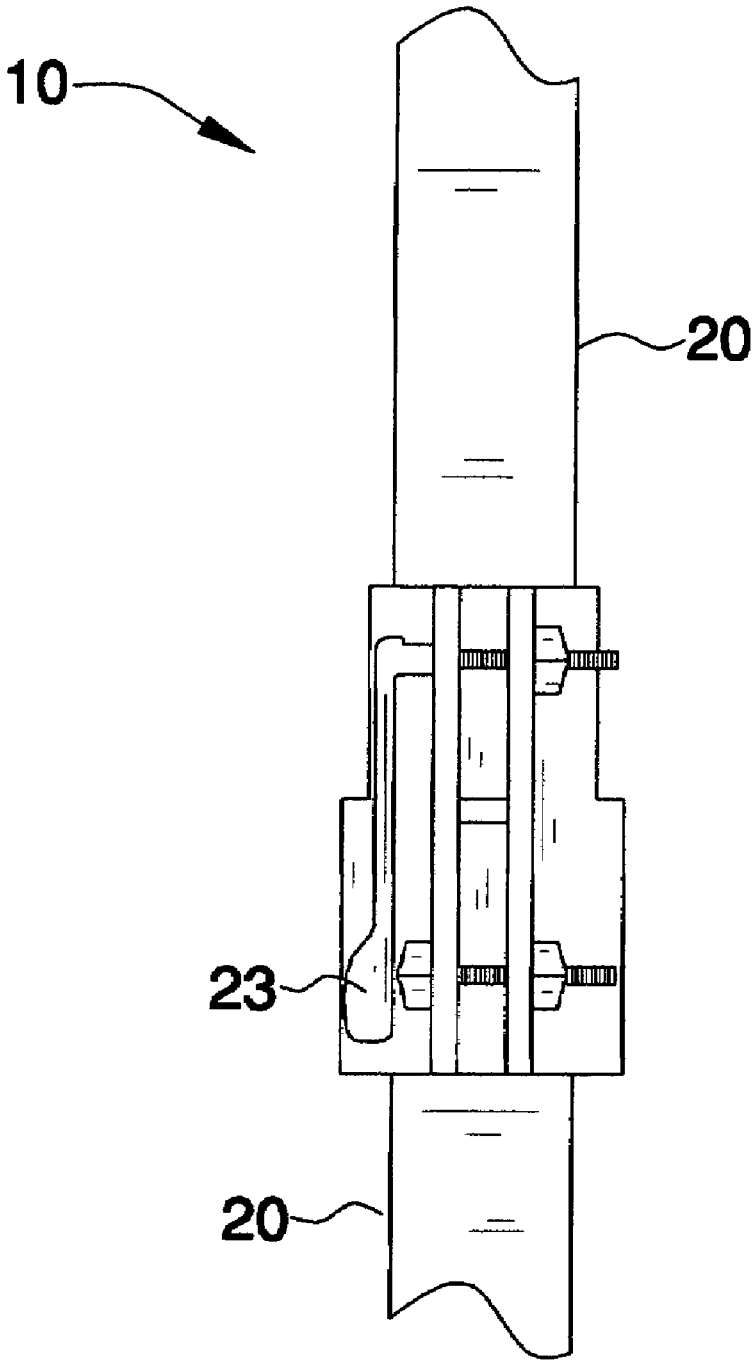
FIG. 9 is an enlarged side-elevational view of the central support shaft shown in FIG. 4, showing the latch attached thereto.
Figure 10:
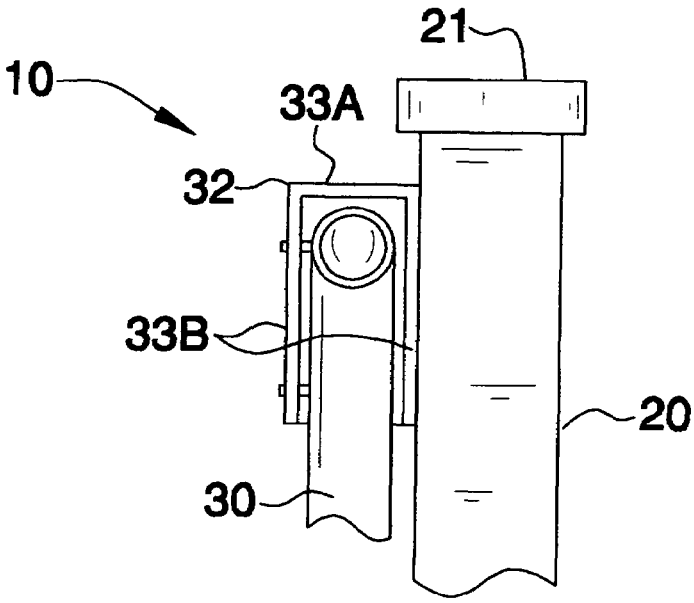
FIG. 10 is a side-elevational view of the upper bracket shown in FIG. 3.
Figure 11:
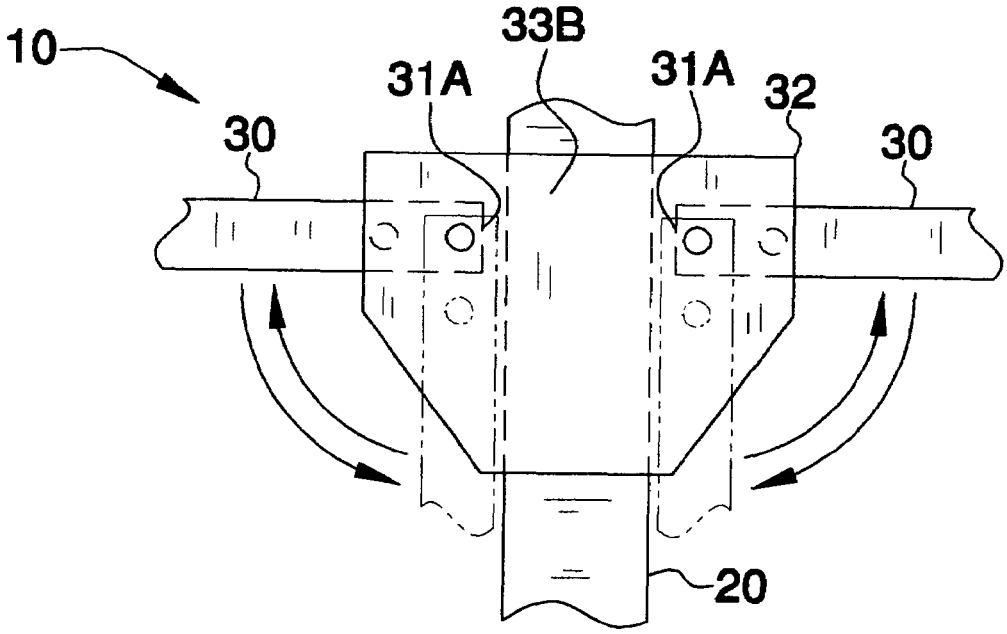
FIG. 11 is an enlarged front-elevational view of the upper bracket shown in FIG. 3.
Figure 12:
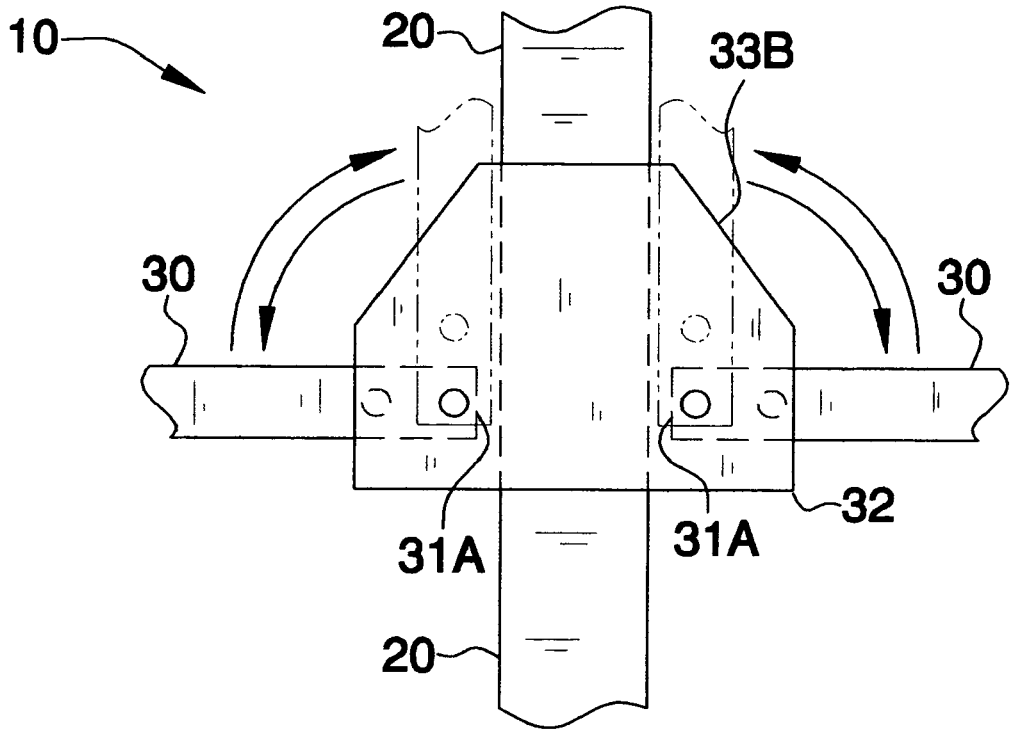
FIG. 12 is an enlarged front-elevational view of the lower bracket shown in FIG. 3.

Referring initially to FIGS. 2, 4 and 9, the apparatus 10 includes a central support shaft 20 that has an elongated and rectilinear shape provided with axially opposed end portions 21 disposed along a vertical axis. Such end portions 21 are elevated above a ground surface during operating conditions. This is an important and advantageous feature for preventing the blinds 11 or screen 12 supported thereon from touching the support surface during cleaning procedures.

The central support shaft 20 includes telescopically engageable female 22A and male 22B members that are essential so that a longitudinal length of the apparatus 10 can conveniently be selectively adjusted as desired by the user. An adjustable length conveniently allows a user to clean window blinds 11 and screens 12 of different sizes through use of the same apparatus 10. A latch 23 is directly fastened, with no intervening elements, to the central support shaft 20 and is pivotally adaptable between locked and unlocked positions, which is critical for effectively prohibiting and allowing the female 22A and male 22B members to slide along the vertical axis respectively.

Referring to FIGS. 1, 2, 3, 4 and 7, a plurality of rectilinear and coextensive legs 24 have axially opposed end portions 25 directly conjoined, with no intervening elements, to a bottom one 21B of the central support shaft end portions 21 and extend outwardly therefrom at an oblique angle offset from the vertical axis. Such legs 24 are selectively pivotal between compressed and expanded positions such that the legs 24 become abutted against the central support shaft 20 when articulated to the compressed position. This is a critical and advantageous feature for allowing the apparatus 10 to be adapted to a more compact shape for easier transport and storage thereof. Each leg 24 is provided with a crucial planar platform 26 suitably sized and shaped for resting on the ground surface, thus allowing the apparatus 10 to remain stable during operating conditions.

Figure 7:
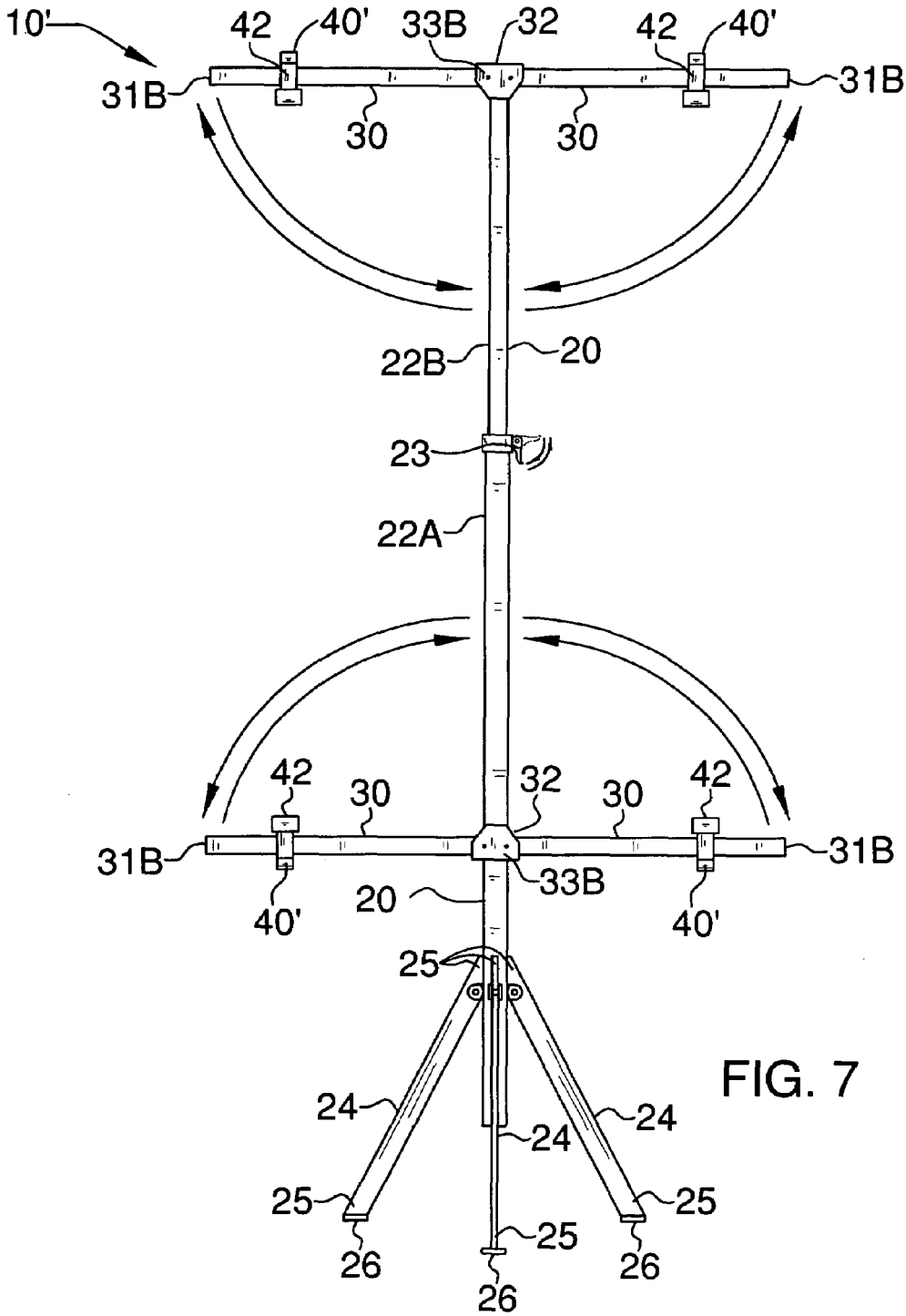
FIG. 7 is a front-elevational view of the apparatus shown in FIG. 3.

Referring to FIGS. 1 through 9, and 10 through 12, a plurality of coextensive auxiliary support shafts 30 have elongated and rectilinear shapes provided with axially opposed medial 31A and lateral 31B end portions. Such auxiliary support shafts 30 are pivotally conjoined to the brackets 32 (described herein below) and selectively pivotal about the medial end portions 31A respectively, which is essential such that the auxiliary support shafts can advantageously be independently biased between vertical and horizontal positions respectively, as is best shown in FIGS. 4 and 7.

Referring to FIGS. 1 through 7, and 10 through 12, a plurality of brackets 32 are directly attached, with no intervening elements, to the central support shaft 20 and vertically spaced along a longitudinal length thereof. Such brackets 32 are provided with a planar medial portion 33A and monolithically formed sides 33B extending away therefrom for defining a pathway through which the medial end portions 31A of the auxiliary support shafts 30 are pivotally seated. The brackets 33 are advantageous and important for ensuring that the auxiliary support shafts 30 remain positioned orthogonally in relation to the central support shaft 20 during operating conditions.

Referring to FIGS. 1 through 3, and 5 through 8, a plurality of clamps 40 are slidably positional along associated ones of the auxiliary support shafts 30 wherein each clamp 40 is selectively adaptable between open and closed positions, which is vital for effectively releasing and gripping the window blind 11 at opposed edges 13 thereof. The window blind 11 is centrally registered between the auxiliary support shafts 30 during cleaning operations, such that same is securely held in place. In a preferred embodiment 10, the clamps 40 include a plurality of hook and loop fasteners 41 for allowing the user to tightly wrap the clamps 40 about opposite ends 13 of the window blinds 11 respectively.

Referring to FIGS. 1, 2, 5*a*, 5*b*, and 7, in an alternate embodiment 10', the clamps 40' include a plurality of spring-loaded clips 42 sized and shaped to conform to a square cross-section of the auxiliary support shafts 30. Such spring-loaded clips 42 are readily positional along a longitudinal length of the auxiliary support shafts 30 without becoming detached therefrom. This embodiment 10' is ideal for use when employing the apparatus 10 to clean a window screen 12 since the hook and loop fasteners 41 can not effectively wrap about the screen's frame 14.

Figure 8:
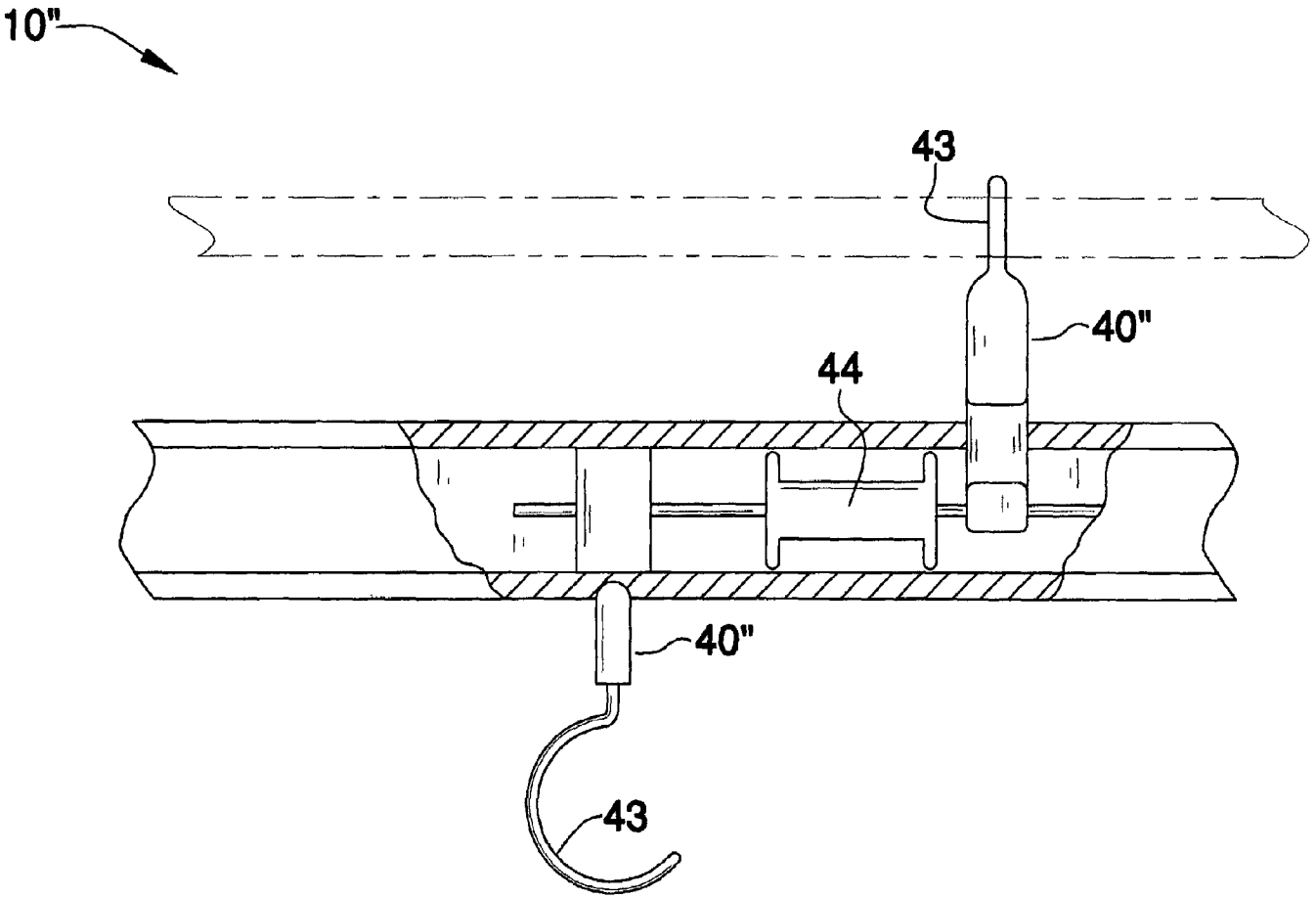
FIG. 8 is an enlarged partially exposed front-elevational view of an upper auxiliary support arm, showing yet another alternate embodiment of the clamps employed by the apparatus 10.

Referring to FIG. 8, in yet another embodiment 10", the clamps 40" include a hooked portion 43, such as commonly seen in clothing hangers, which is rotationally adjustable about the auxiliary support shafts 30. Adjacent hooked portions 43 have a spacer 44 positioned therebetween along an interior surface of the auxiliary support shaft 30 that is essential for limiting a horizontal movement of the hooked members 43.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus holding an existing window blind at an upright position during cleaning procedures, said apparatus comprising:

a central support shaft having an elongated and rectilinear shape provided with axially opposed end portions disposed along a vertical axis, said end portions being elevated above a ground surface during operating conditions;

a plurality of rectilinear legs having axially opposed end portions directly conjoined to a bottom one of said central support shaft end portions and extending outwardly therefrom at an oblique angle offset from the vertical axis, said legs being selectively pivotal between compressed and expanded positions such that said legs become abutted against said central support shaft when articulated to the compressed position;

a plurality of coextensive auxiliary support shafts having elongated and rectilinear shapes provided with axially opposed medial and lateral end portions;

a plurality of brackets directly attached to said central support shaft and vertically spaced along a longitudinal length thereof; and a plurality of clamps slidably positional along associated ones of said auxiliary support shafts wherein each said clamps is selectively adaptable between open and closed positions for releasing and gripping the existing window blind at opposed edges thereof, the existing window blind being centrally registered between said auxiliary support shafts during cleaning operations;

wherein said auxiliary support shafts are pivotally conjoined to said brackets and selectively pivotal about said medial end portions respectively such that said auxiliary support shafts can be independently biased between vertical and horizontal positions respectively;

wherein selected ones of said clamps include a plurality of hook and loop fasteners for allowing the user to tightly wrap said selected clamps about opposite ends of the window blind respectively, said selected clamps further including a plurality of linear segments monolithically connected to each other and configured in such a manner that selected ones of said linear segments overlap each other when adapted about said auxiliary support shafts;

wherein first, second and third ones of said linear segments directly and contiguously abut first, second and third faces of said auxiliary support shafts respectively;

wherein a fourth one of said linear segments travels downwardly from said third linear segment and terminates adjacent to the existing window blind;

wherein a fifth one of said linear segments spans beneath a top one of the opposite ends of the existing window blind and is engaged therewith;

wherein a sixth one of said linear segments travels upwardly from the existing window blind and terminates adjacent to said first face of said auxiliary support shafts;

wherein seventh and eight ones of said linear segments are removably engaged with said first and second linear segments such that said selected clamps maintain a firm grip against said auxiliary support shafts and the top end of the existing window blind.

2. The apparatus of claim 1, wherein said central support shaft comprises:

telescopically engageable female and male members so that a longitudinal length of said apparatus can be selectively adjusted as desired by the user; and a latch directly fastened to said central support shaft and pivotally adaptable between locked and unlocked positions for prohibiting and allowing said female and male members to slide along the vertical axis respectively.

3. The apparatus of claim 1, wherein each said legs are provided with a planar platform suitably sized and shaped for resting on the ground surface.

4. The apparatus of claim 1, wherein said brackets are provided with a planar medial portion and monolithically formed sides extending away therefrom for defining a pathway through which said medial end portions of said auxiliary support shafts are pivotally seated.

* * * * *